US006825138B2

(12) United States Patent
Lack

(10) Patent No.: US 6,825,138 B2
(45) Date of Patent: Nov. 30, 2004

(54) WRINKLE FREE-WATER RESISTANT FABRICS AND GARMENTS AND METHOD

(75) Inventor: Ronnie Franklin Lack, Mize, MS (US)

(73) Assignee: Warmkraft, Inc., Taylorsville, MI (US)

( * ) Notice: Subject to any disclaimer, the term of this patent is extended or adjusted under 35 U.S.C. 154(b) by 150 days.

(21) Appl. No.: 10/121,993

(22) Filed: Apr. 12, 2002

(65) Prior Publication Data

US 2002/0137414 A1 Sep. 26, 2002

Related U.S. Application Data

(63) Continuation-in-part of application No. 09/388,738, filed on Sep. 2, 1999, now Pat. No. 6,372,674.

(51) Int. Cl.[7] ..... B32B 9/04; B32B 27/04; B32B 27/12; B32B 5/02

(52) U.S. Cl. ..... 442/153; 442/93; 442/104; 442/107; 442/152; 442/164; 442/165; 427/400; 427/430.1; 427/393.2; 427/393.4; 8/115.51; 8/116.1; 8/195

(58) Field of Search ..... 442/79, 82, 86, 442/88, 93–94, 107, 152, 153, 163; 427/400, 430.1, 393.2, 393.4; 8/115.51, 116.1, 195

(56) References Cited

U.S. PATENT DOCUMENTS 3,606,992 A * 9/1971 Aldrich ..... 8/115.6
3,617,188 A * 11/1971 Snyder ..... 427/393.4
3,649,165 A * 3/1972 Cotton ..... 8/115.59
4,562,097 A 12/1985 Walter et al.
5,614,591 A * 3/1997 Basinger et al. ..... 525/163
5,856,245 A 1/1999 Caldwell et al.
5,869,172 A 2/1999 Caldwell
5,874,164 A 2/1999 Caldwell
5,912,116 A 6/1999 Caldwell

FOREIGN PATENT DOCUMENTS

WO 9949124 9/1999
WO 9949125 9/1999
WO WO 99/49125 * 9/1999 ..... D06M/13/184

* cited by examiner

*Primary Examiner*—Elizabeth M. Cole
*Assistant Examiner*—Norca L. Torres
(74) *Attorney, Agent, or Firm*—Volpe and Koenig, P.C.

(57) ABSTRACT

A textile treatment process, treatment bath, and treated fabric are disclosed. The process imparts water repellant, stain resistant, and wrinkle-free properties as well as aesthetically pleasing hand properties to a fabric made in whole or in part of fibers having a hydroxyl group, such as cellulosic fibers, though immersion in an aqueous bath and subsequent heating for curing. The aqueous treatment bath contains a urea resin, polytetrafluorethylene (PTFE) and, preferably, fluoroalkyl acrylate co-polymer.

45 Claims, 5 Drawing Sheets

Example A: Garment Application With Batch Processing

Pounds of Garments (fabric) Treated= 1000

Condition 1: application of 100% of bath on garment

Condition 2: application of 100% of weight of garment (weight after application=2000)

| Chemicals % solids | Actual % Solids on Fabric | Chemical Used | % of Product on weight of Garments/Fabric | pounds of chemical on Garments/Fabric | pounds of chemicals needed at 100% application | Chemicals % of bath |
|---|---|---|---|---|---|---|
| | | | | | | |
| | | Water | | | 815 | 81 5% |
| 60% | 0.3% | TE-3667N (PTFE) | 0.5% | 5 | 5 | 0.5% |
| 22% | 2 2% | DMDHEU (22% sol.) | 10.0% | 100 | 100 | 10.0% |
| 100% | 2.5% | Mg Chorlide | 2.5% | 25 | 25 | 2.5% |
| 40% | 2.0% | NICCA NFN-158 | 5.0% | 50 | 50 | 5.0% |
| 100% | 0.5% | Ethoxylated Alcohol | 0.5% | 5 | 5 | 0.5% |
| | | | | Total | 1000 | 100.0% |

FIGURE 2

Example B: Garment Application With Batch Processing

Pounds of Garments (fabric) Treated= 1000

Condition 1: application of 100% of bath on garment

Condition 2: application of 50% of weight of garment (weight after application=1500)

| Chemicals % solids | Actual % Solids on Fabric | Chemical Used | % of Product on weight of Garments/Fabric | pounds of chemical on Garments/Fabric | pounds of chemicals needed at 50% application | Chemicals % of bath |
|---|---|---|---|---|---|---|
| | | | | | | |
| | | Water | | | 315 | 63.0% |
| 60% | 0 3% | TE-3667N (PTFE) | 0.5% | 5 | 5 | 1.0% |
| 22% | 2.2% | DMDHEU (22% sol.) | 10.0% | 100 | 100 | 20.0% |
| 100% | 2.5% | Mg Chorlide | 2.5% | 25 | 25 | 5.0% |
| 40% | 2.0% | NICCA NFN-158 | 5.0% | 50 | 50 | 10.0% |
| 100% | 0 5% | Ethoxylated Alcohol | 0.5% | 5 | 5 | 1.0% |
| | | | | Total | 500 | 100.0% |

FIGURE 3

Example C: Garment Application With Continous Processing

Condition: application of 50% of weight of garment
(weight of 1000 lb. of garments after bath application=1500 lb.)

| Chemicals % solids | Actual % Solids on Fabric | Chemical Used | % of Product on weight of Garments/Fabric | pounds of chemical on 1000 pounds of Garments/Fabric | pounds of chemicals needed per 500 pounds of bath | Chemicals % of bath |
|---|---|---|---|---|---|---|
| | | | | | | |
| | | Water | | | 315 | 63.0% |
| 60% | 0.3% | TE-3667N (PTFE) | 0.5% | 5 | 5 | 1.0% |
| 22% | 2.2% | DMDHEU (22% sol.) | 10.0% | 100 | 100 | 20.0% |
| 100% | 2.5% | Mg Chorlide | 2.5% | 25 | 25 | 5.0% |
| 40% | 2.0% | NICCA NFN-158 | 5.0% | 50 | 50 | 10.0% |
| 100% | 0.5% | Ethoxylated Alcohol | 0.5% | 5 | 5 | 1.0% |
| | | | | Total | 500 | 100 0% |

FIGURE 4

Example D: Garment Application With Continous Processing

Condition: application of 60% of weight of garment
(weight of 1000 lb. of garments after bath application=1600 lb.)

| Chemicals % solids | Actual % Solids on Fabric | **Chemical Used** | **% of Product on weight of Garments/Fabric** | pounds of chemical on 1000 pounds of Garments/Fabric | pounds of chemicals needed per 2500 pounds of bath | Chemicals % of bath |
|---|---|---|---|---|---|---|
| | | | | | | |
| | | **Water** | | | 1729 | 69.2% |
| 60% | 0.3% | **TE-3667N (PTFE)** | **0.5%** | 5 | 21 | 0.8% |
| 22% | 2.2% | **DMDHEU (22% sol.)** | **10.0%** | 100 | 417 | 16.7% |
| 100% | 2.5% | **Mg Chorlide** | **2.5%** | 25 | 104 | 4.2% |
| 40% | 2.0% | **NICCA NFN-158** | **5.0%** | 50 | 208 | 8.3% |
| 100% | 0.5% | **Ethoxylated Alcohol** | **0.5%** | 5 | 21 | 0.8% |
| | | | | Total | 2500 | 100.0% |

FIGURE 5

WRINKLE FREE-WATER RESISTANT FABRICS AND GARMENTS AND METHOD

CROSS-REFERENCE TO RELATED APPLICATION

This application is a continuation-in-part application of U.S. Pat. Ser. No. 09/388,738 now U.S. Pat. No. 6,372,674, filed Sep. 2, 1999.

FIELD OF THE INVENTION

The present invention relates to the treatment oftextiles, and more particularly to fabrics having water repellant, stain resistant, and wrinkle-free properties and methods of producing same. Most particularly, the present invention relates to producing water repellant, stain resistant, and wrinkle-free fabrics which display excellent hand and feel.

BACKGROUND OF THE INVENTION

U.S. Pat. No. 5,856,245 discloses an example of a barrier web comprising a fabric that has been treated with a curable shear thinned thixotropic polymer composition, the fabric being substantially impermeable to liquids, permeable to gases and impermeable to all microorganisms.

U.S. Pat. No. 5,869,172 discloses an example of processes for treating a porous substrate which involves controlled placement of modifiers through the manipulation of chemical and physical properties inherent in the modifiers to produce internally coated porous materials. The treatment involves impregnating the porous substrate with a curable thixotropic material and one or more modifying materials to impart desired properties.

U.S. Pat. Nos. 5,874,164 and 5,912,116 provide examples of a barrier web comprising a fabric that has been treated with a curable shear thinned thixotropic polymer composition. The fabric is substantially impermeable to liquids, permeable to gases and impermeable to all microorganisms. The barrier webs are either impermeable to all microorganisms or are impermeable to microorganisms of certain sizes. These patents also disclose fabrics that are capable of selectively binding certain microorganisms, particles or molecules depending upon the binding agents incorporated into the polymer before application to the fabric.

SUMMARY OF THE INVENTION

The present invention is directed to a textile treatment process that imparts water repellant, stain resistant, and wrinkle-free properties as well as aesthetically pleasing hand properties to a fabric made in whole or in part of fibers having a hydroxyl group, such as cellulosic fibers. The present invention is also directed to the resultant fabric of the process.

The fabrics are treated by immersion into an aqueous bath thereby applying a controlled amount of the bath to the fabric. The fabrics are then preferably dried to their natural regain, and pressed to remove unwanted wrinkles. Thereafter heat is applied to cure the reactants.

The aqueous bath is preferably formulated to apply to the fabric 8% to 14% by weight of the fabric of a reactive modified ethylene urea resin solution and 4% to 10% by weight of a crosslinking polytetrafluorethylene additive which is at least 25% by weight polytetrafluorethylene. Upon immersion of a fabric which has fibers having a hydroxyl group, such as cellulosic fibers, and subsequent heating, the urea resin reacts with the hydroxyl group and forms crosslinks with the polytetrafluorethylene to impart the desired properties to the fabric.

Alternatively, the bath is formulated to apply 0.6% to 3.3% by weight of the fabric of a urea resin, preferably DMDHEU, 0.3% to 1.5% polytetrafluorethylene (PTFE), and 1 to 4% fluoroalkyl acrylate co-polymer. A bonding reaction between the urea resin and the hydroxyl group on the fabric is initiated upon immersion of the fabric and strengthened when heat is applied during the drying and curing processes.

Preferably, the bath contains a buffer to maintain pH in a range of 3.5 to 5.5 and a catalyst to speed the reaction.

Objects and advantages of the present invention will become more readily apparent to those skilled in the art upon consideration of the following detailed description which describes a preferred embodiment of the invention.

BRIEF DESCRIPTION OF THE DRAWING(S)

FIGS. 2 and 3 are tables for example baths used in batch processing.

FIGS. 4 and 5 are tables for example baths used in continuous processing.

DETAILED DESCRIPTION OF THE PREFERRED EMBODIMENT(S)

Figure 1:
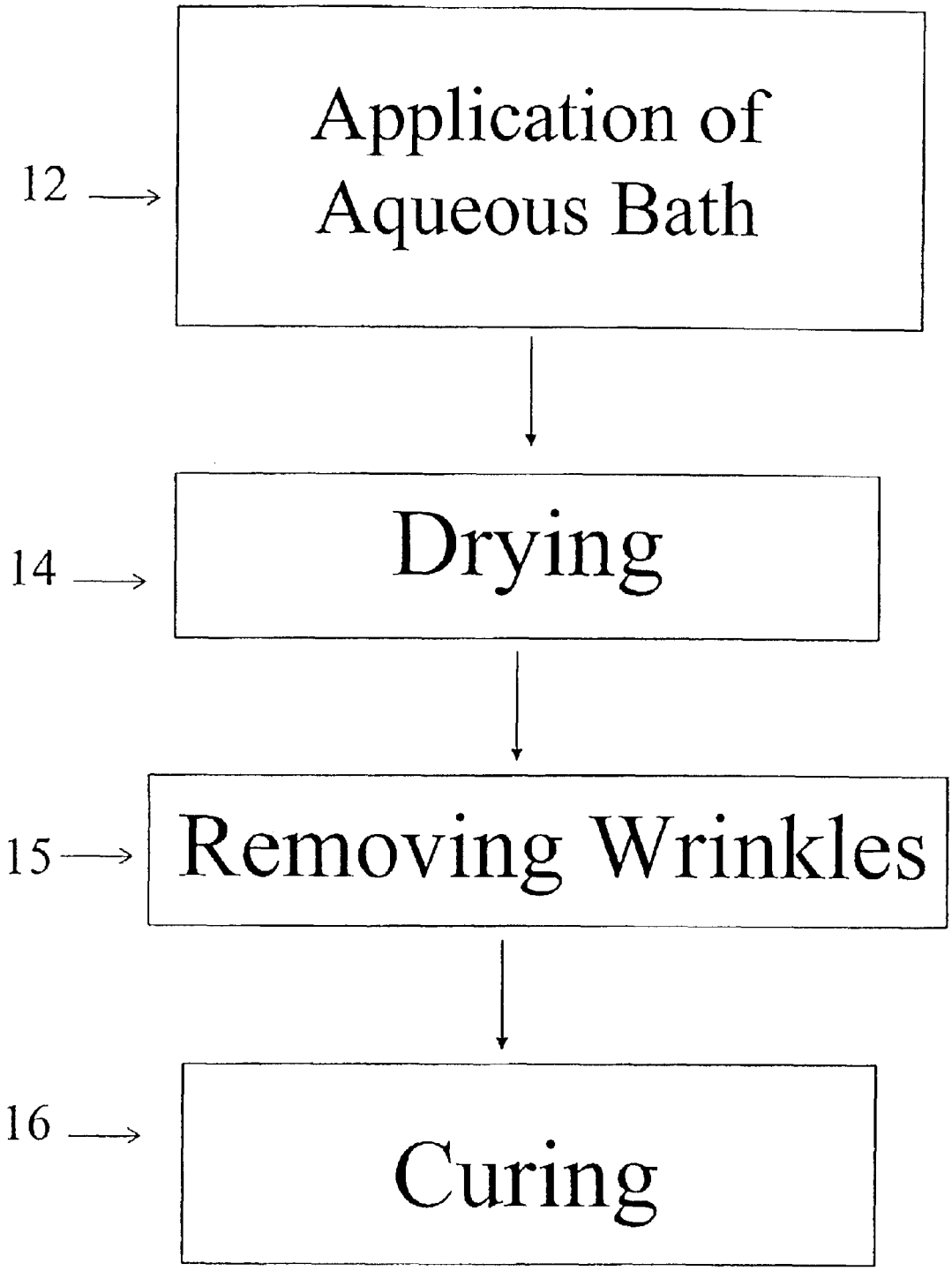
FIG. 1 is a schematic illustration of the textile treatment process according to the invention.

The present invention is directed to a water repellant, stain resistant, breathable, wrinkle-free fabric which retains the hand and feel of the untreated textile. The fabric is prepared by treating a textile made with preferably at least 10% fibers which have a hydroxyl group such as cellulosic fibers. The textile is immersed in a bath having a unique combination of urea resin and a fluorochemical PTFE, such as polytetrafluorethylene (PTFE), which reacts with cellulosic fabric fibers and is cured on the fabric to form a polymer network.

The aqueous treatment bath contains a reactive modified ethylene urea resin solution such as a 22% solution of dimethylol dihydroxy ethylene urea (DMDHEU). The amount of such modified ethylene urea resin solution applied by the treatment bath preferably ranges from 8 to 14% by weight of the fabric, which equals 0.6% to 3.3% by weight of the fabric of DMDHEU. The amount of fluorochemical PTFE applied by the treatment bath is about 0.3% by weight and preferably ranges from 0.1% to 3% by weight. Fluoroalkyl acrylate co-polymer is also preferably applied by the treatment bath at an amount ranging from 1 to 4% by weight of the fabric.

Commercial polytetrafluorethylene additive products which are made from as low as 25% by weight powdered polytetrafluorethylene, such as ZONYL® PTFE, which is available from E.I. du Pont de Nemours and Company can be used to provide the necessary fluorochemical co-polymer PTFE and fluoroalkyl acrylate co-polymer. Such additives may also be introduced in a premixed form such as ZONYL® FMX sold by Ciba Specialty Chemical Products. If ZONYL® PTFE having fluoroalkyl acrylate co-polymer is used in the treatment bath, it is preferably applied by the bath at an amount ranging from 4 to 10% by weight.

The aqueous bath preferably also includes one or more additives selected from a group of buffering agents and catalysts. Buffering agents help control the acidity, or pH, of the bath and help reduce tendering of the fabric. Typical buffering agents include acetic acid, citric acid, maleic acid, and other suitable weak acids. The buffering agent is used to adjust the pH to a range of 3.5 to 5.5, preferably no more than 4.5.

A catalyst can be used to help speed the reaction so that a simple immersion technique can be used during the treatment process instead of prolonged saturation of the fabric and to reduce curing time. Typical catalysts that can be used are parabolic catalysts such as magnesium chloride or aluminum chloride.

In one preferred formulation, a liquid premix containing fluorochemical PTFE and fluoroalkyl acrylate co-polymer is used in preparing the aqueous bath. Premixed products which include a suspension agent and a surfactant, are preferred to allow the fluorochemical PTFE and fluoroalkyl acrylate co-polymer to readily mix with the modified ethylene urea resin. On a weight percent basis, the treatment bath may apply 1 to 2% hexylene glycol as a suspension agent, and 0.5 to 1.5% ethoxylated aliphatic alcohol as a surfactant to the fabric being treated. If ZONYL® PTFE is used, a premixed combination of ZONYL® PTFE with hexylene glycol and ethoxylated aliphatic alcohol is ZONYL® FMX, sold by Ciba Specialty Chemicals Corporation of High Point, NC.

In another preferred formulation, ZONYL® TE-3667N PTFE, which is an aqueous suspension of a hydrophobic colloid containing approximately 60% by total weight of 0.05 to 0.5 $\mu$m PTFE resin particles, is used for providing at least 0.2% by weight of the fabric of PTFE via the applied bath and a 40% co-polymer solution of fluoroalkyl acrylate such as NFN-158 available from NICCA Chemical USA of Simpsonville, S.C., is used to provide at least 1% fluoroalkyl acrylate co-polymer to the fabric via the applied bath. A surfactant, such as ethoxylated aliphatic alcohol is also preferably used.

The fabrics treated in the bath are made at least in part of fibers which contain hydroxyl groups which act as a binding site for the urea resin. One type of hydroxyl containing fibers are cellulosic fibers which include natural fibers such as cotton and synthetic materials such as rayon. Accordingly, fabrics made of cotton, rayon and cotton and rayon blends are suitable for treatment using the inventive process. When the textile is immersed in the treatment bath, the DMDHEU reacts with the hydroxyl groups of fibers and acts as a binding site for the urea resin. The binding or crosslinking of the hydroxyl groups and the urea resin enhance the adhesion of the PTFE. The combination of these components results in a synergistic effect in which the fabric displays water resistant, stain resistant, and wrinkle-free properties while maintaining excellent hand.

FIG. 1 schematically illustrates the process of the present invention by which fabrics having cellulosic fibers are treated to impart water repellant, stain resistant, and wrinkle-free properties. First the [aqueous treatment bath] is prepared and the fabric is immersed in the bath or otherwise applied using conventional means 12. The fabric is then dried 14 to its natural regain. Where the immersion and drying steps result in wrinkling of the fabric, pressing 15 is then conducted to remove the wrinkles. Finally, the fabric is heated 16 to cure the treated fabric to impart water repellant, stain resistant, and wrinkle-free properties to the fabric.

For garments, the bath immersion may be effected in a bath process by placing the garment in a treatment vessel and immersing the garment in the aqueous bath 12. The garments are then preferably tumble dried 14 with heated air to the natural regain of the textile fibers. The natural regain of cotton is 8 to 10%, rayon 12 to 14%, and 1% for polyester so that drying time varies dependent upon whether the fabric is 100% cellulosic fiber or a blend with, for example, polyester, i.e. cotton/polyester; rayon/polyester, etc. After tumble drying, the garments are pressed to remove unwanted wrinkles 15 and directed through a heated curing oven 16 at a temperature of 325 to 330 degrees F. preferably for at least eight to fifteen minutes to cure and crosslink the treatment composition, which imparts water resistant, stain resistant and wrinkle-free properties without destroying the natural hand or feel of the fabric.

Alternatively, garments or bolts of fabric may be treated by a conventional continuous process, where they are conveyed through the bath, wrung dry using a nip and/or air dried to natural regain, and then cured by passage through a continuous processing oven. Where sheets of fabric are dried through passage through a nip, the nip may also serve to remove wrinkles thereby eliminating a separate pressing step.

After treatment, the fabric can withstand repeated washing with no significant degradation of the water resistant, stain resistant and wrinkle-free properties.

In one example, a bath was prepared by mixing equal parts of a 22% aqueous solution of DMDHEU with the liquid premix described above. Acetic acid was added to adjust the pH to be between 3.5 and 4.5 and magnesium chloride was added as a catalyst. The resultant aqueous bath as applied to a fabric contained by weight: about 11% DMDHEU, about 2% fluorochemical PTFE, about 2.5% fluoroalkyl acrylate co-polymer, about 1.5% hexylene glycol, about 1% ethoxylated aliphatic alcohol, about 0.1% acetic acid, and about 4% magnesium chloride.

Garments made of 100% cotton fiber were immersed in the bath, dried to 8 to 10% moisture content, pressed to remove unwanted wrinkles, and cured to a temperature of about 325 degrees F. for approximately 15 minutes. The resultant treated garments exhibited excellent water and stain resistant and wrinkle-free properties, even after repeated washing.

Similar results were achieved using a bath prepared by mixing equal parts of a 22% aqueous solution of DMDHEU with ZONYL® FMX. Acetic acid was added to adjust the pH to be between 3 and 4.5 and magnesium chloride was added as a catalyst. The resultant aqueous bath as applied to the fabric contained by weight: about 11% DMDHEU, about 7% ZONYL® PTFE, about 1.5% hexylene glycol, about 1% ethoxylated aliphatic alcohol, about 0.1% acetic acid, and about 4% magnesium chloride.

Further examples are provided with reference to the tables set forth in FIGS. 2–5. Examples A and B provide similar bath formulations for batch processing at two different rates of application to garments/fabric being treated. Example C and D are directed to a bath where continuous processing at two different levels of application to the garments/fabric being treated. In all of the Examples A–D, the bath is a mixture of water, ZONYL® TE-3667N (60% PTFE suspension in water), a 22% by weight solution of DMDHEU, magnesium chloride, NICCA-NFN-158 solution (40% flouroalkyl acrylic co-polymer) and ethoxylated aliphatic alcohol.

In the Examples A–D, the chemicals are mixed in the proportions indicated in the seventh column of each of the tables such that the garments absorb the percentage of the chemical indicated in the fourth column of each of the tables, FIG. 2–FIG. 5. FIG. 2 provides an illustration where an equal weight of bath is applied to the garment so that after treating, and before drying, a batch of 1000 pounds of garments will weigh 2000 pounds having absorbed 1000 pounds of the bath. To produce the percentages of weight on the garment of the respective constituent bath chemicals which impart the wrinkle free and water resistant characteristics set forth in column 4 of FIG. 2, the number of pounds of each material and their proportion for the bath are set forth in the sixth and seventh column of the table of FIG. 2 where 1000 pounds of bath treatment is applied to 1000 pounds of garment.

With respect to Example B, FIG. 3, 1000 pounds of garments are treated with 50% by weight of bath i.e. 500 pounds of bath. In order to provide the same percentages by weight of the desired chemicals on the garments after the bath application as in Example A, the actual pounds in proportion of chemicals for the bath at an application rate of 50% of the garment is set forth in sixth and seventh columns of FIG. 3.

As shown in FIG. 4, Example C provides a table for a bath used in continuous processing where 50% by weight of the bath is applied to the garments/fabric being treated. Since the application rate is the same for Examples B and C, the same percentage formulation for the bath is required for the continuous processing of Example C as it is for the batch processing of Example B. This is reflected in the seventh column of both examples, FIGS. 3 and 4, respectively. While Example C refers to treating 1000 pounds of garments using 500 pounds of bath at a 50% application rate, for continuous processing any weight of garments/fabric may be processed and the bath is continuously supplied as long as processing continues.

Where the bath application rate changes, the percentage of the makeup of the bath also correspondingly changes in order to maintain the same percentage of the desired chemicals being applied to the garments. For example, in Example D the rate of application of the bath is changed to 60% of the weight of the garment in comparison to Example C which is set forth for 50% application of the bath to the garments being treated. In order to have the same weight of the desired chemicals applied to the garments/fabric being treated, as reflected in the fourth column of Examples C and D, the actual bath component formulations, set forth in the seventh column, are correspondingly changed to account for the different application rates. Whether batch or continuous processing is used, one of ordinary skill of the art can easily calculate the composition of the bath to produce the desired proportionate application of chemicals on the fabric based on the application rate of the bath on the garments/fabric by simple well known mathematical calculations.

In bath processing, whether batch or continuous, the application rate is a function of a number of factors such as type of material, type of weave, fabric caliper etc. Even for an unknown fabric it is relatively easy to determine the application rate through the simple process of applying the bath to a known weight of garment and weighing the resultant garment after application of the bath to determine the total weight of the bath absorbed by the garment. In a large number of application, the application rate of the bath is about 50 or 60% by weight of the garment.

In using the combination of chemicals of Examples A–D, it is preferred that the percent of the active chemicals by weight of fabric as actually applied to the garments/fabric is in the range of 0.5 to 5% of the preferred ZONYL® TE-3667N 60% PTFE suspension and in the range of 3–15% of the preferred 22% solution of the DMDHEU. Accordingly, this results in a preferred application of 0.3 to 3% PTFE and 0.66 to 3.3% of DMHEU by weight of the fabric on the fabric. The amount of DMDHEU can be varied in accordance with the type of fabric. For example, light weight shirts of 100% cotton are preferably be treated with a bath which imparts the lower range of the DMDHEU. In contrast, a cotton/nylon blend fabric is preferably be treated with the higher end range of DMDHEU.

Preferably, fluoroalkyl acrylate co-polymer is applied so that 1 to 4% by weight of the fabric is applied by the bath treatment. Where NICCA NFN-158 solution, which contains 40% fluoroalkyl acrylate co-polymer, is used, the bath preferably applies 2.5 to 10% NICCA NFN-158 solution to the fabric. The bath also preferably applies up to about 1% of the fabric weight of a surfactant such as ethoxylated aliphatic alcohol and up to about 4% of the fabric weight of a catylst such as magnesium chloride. Aecetic acid or the like may be used to control pH as discussed above in the range of 3.5 to 4.5

While the invention has been described with respect to the specific formulations, other variations will be apparent to those of ordinary skill in the art and are included within the scope of the present invention.

What is claimed is:

1. A fabric having water resistant, stain resistant and wrinkle-free properties comprising at least 10% reacted hydroxyl group containing fibers wherein the fabric has been treated such that 8% to 14% by weight of the fabric of a reactive modified ethylene urea resin solution and 4% to 10% by weight of the fabric of a polytetrafluorethylene additive, which is at least 25% by weight of a crosslinking polytetrafluorethylene (PTFE), is applied to the fabric and the treated fabric has been cured such that the urea resin reacts with the hydroxyl group and forms crosslinks with the polytetrafluorethylene to impart the properties to said fabric.

2. The fabric according to claim 1 wherein said polytetrafluorethylene additive includes a suspension of small PTFE resin particles.

3. The fabric according to claim 1 wherein said modified ethylene urea resin solution is a solution of about 22% dimethylol dihydroxy ethylene urea (DMDHEU).

4. The fabric according to claim 1 wherein the hydroxyl group containing fibers are cellulosic fibers.

5. A fabric according to claim 4 which is a cotton blend wherein the cellulosic fibers are cotton.

6. A fabric according to claim 4 which is 100% cotton.

7. A fabric according to claim 4 which is a rayon blend wherein the cellulosic fibers are rayon.

8. A fabric according to claim 4 which is 100% rayon.

9. A garment having water and stain resistant and wrinkle-free properties comprising the fabric according to claim 4.

10. A fabric having water resistant, stain resistant and wrinkle-free properties comprising at least 10% reacted hydroxyl group containing fibers wherein the fabric has been treated such that 0.6% to 3.3% by weight of the fabric of a reactive modified ethylene urea resin and at least 0.2% by weight of the fabric of a crosslinking polytetrafluorethylene (PTFE) is applied to the fabric and the treated fabric has been cured such that the urea resin reacts with the hydroxyl group and forms crosslinks with the polytetrafluorethylene to impart the properties to said fabric.

11. The fabric according to claim 10 wherein the fabric is treated such that 0.3% to 3% by weight of a crosslinking polytetrafluorethylene (PTFE) and also 1% to 4% by weight of a fluoroalkyl acrylate co-polymer is applied.

12. The fabric according to claim 11 wherein said modified ethylene urea resin is dimethylol dihydroxy ethylene urea (DMDHEU).

13. The fabric according to claim 12 wherein a surfactant is also applied to the fabric when it is treated.

14. The fabric according to claim 11 wherein where the DMDHEU is provided as a solution of about 22% DMD- HEU such that 3% to 15% by weight of the fabric of that solution is applied, the PTFE is provided as a suspension of about 60% PTFE such that 0.5% to 5% by weight of the fabric of that suspension is applied, and the fluoroalkyl acrylate co-polymer is provided as a solution of about 40% fluoroalkyl acrylate co-polymer such that 2.5% to 10% by weight of the fabric of the fluoroalkyl acrylate co-polymer solution is applied.

15. The fabric according to claim 14 wherein the fabric is treated such that magnesium chloride in an amount up to 4% of the fabric weight and ethoxylated aliphatic alcohol in an amount up to 1% of the fabric weight are applied to the fabric.

16. A fabric according to claim 10 where the hydoxyl group containing fibers are cellulosic fibers.

17. A fabric according to claim 16 which is a cotton blend wherein the cellulosic fibers are cotton.

18. A fabric according to claim 16 which is 100% cotton.

19. A fabric according to claim 16 which is a rayon blend wherein the cellulosic fibers are rayon.

20. A fabric according to claim 16 which is 100% rayon.

21. A garment having water and stain resistant and wrinkle-free properties comprising the fabric according to claim 16.

22. A process for imparting water resistant, stain resistant and wrinkle-free properties to a fabric made at least in part of fibers having a hydroxyl group, such as cellulosic fibers, comprising:

immersing the fabric in an aqueous bath containing formulated to apply to the fabric:

8% to 14% by weight of the fabric of a reactive modified ethylene urea resin solution; and 4% to 10% by weight of the fabric of a polytetrafluorethylene additive which is at least 25% by weight of a crosslinking polytetrafluorethylene (PTFE); and subsequently heating the fabric to cure the reactants on the fabric.

23. A process according to claim 22 further comprising drying the fabric to its natural regain after immersion and then removing wrinkles from the fabric before curing.

24. The process according to claim 23 wherein said heating to cure is at a temperature of 325 degrees to 330 degrees F. for at least 8 to 15 minutes.

25. The process according to claim 22 wherein said polytetrafluorethylene additive includes a suspension of small PTFE resin particles.

26. The process according to claim 22 wherein said modified ethylene urea resin solution is a solution of about 22% dimethylol dihydroxy ethylene urea (DMDHEU).

27. The process according to claim 22 wherein said aqueous bath includes a catalyst selected from a group of parabolic acids.

28. The process according to claim 27 wherein said aqueous bath includes a buffering agent selected from a group of weak acids.

29. The process according to claim 28 wherein said modified ethylene urea resin solution is a solution of about 22% dimethylol dihydroxy ethylene urea (DMDHEU), said buffering agent is acetic acid, and said catalyst is magnesium chloride.

30. A process for imparting water resistant, stain resistant and wrinkle-free properties to a fabric made at least in part of fibers having a hydroxyl group, such as cellulosic fibers, comprising:

immersing the fabric in an aqueous bath containing formulated to apply to the fabric:

0.6% to 3.3% by weight of the fabric of a reactive modified ethylene urea resin; and at least 0.2% by weight of the fabric of a crosslinking polytetrafluorethylene (PTFE); and subsequently heating the fabric to cure the reactants on the fabric.

31. The process according to claim 30 further comprising drying the fabric to its natural regain after immersion and then removing wrinkles from the fabric before curing.

32. The process according to claim 31 wherein said heating to cure is at a temperature of 325 degrees to 330 degrees F. for at least 8 to 15 minutes.

33. The process according to claim 30 wherein the bath is formulated to apply 0.3% to 3% by weight of a crosslinking polytetrafluorethylene (PTFE) and also 1% to 4% by weight of a fluoroalkyl acrylate co-polymer.

34. The process according to claim 30 wherein said modified ethylene urea resin is dimethylol dihydroxy ethylene urea (DMDHEU).

35. The process according to claim 30 wherein said aqueous bath includes a catalyst selected from a group of parabolic acids.

36. The process according to claim 35 wherein said catalyst comprises magnesium chloride.

37. The process according to claim 35 wherein said aqueous bath includes a buffering agent selected from a group of weak acids.

38. The process according to claim 37 wherein the buffering agent comprises acetic acid.

39. The process according to claim 30 wherein said aqueous bath includes a surfactant.

40. The process according to claim 39 wherein said surfactant comprises ethoxylated aliphatic alcohol.

41. The process according to claim 30 wherein said aqueous bath includes a suspension agent.

42. The process according to claim 41 wherein said suspension agent comprises hexylene glycol.

43. The process according to claim 33 where the DMDHEU is provided as a solution of about 22% DMDHEU such that 3% to 15% by weight of the fabric of that solution is applied, the PTFE is provided as a suspension of about 60% PTFE such that 0.5% to 5% by weight of the fabric of that suspension is applied, and the fluoroalkyl acrylate co-polymer is provided as a solution of about 40% fluoroalkyl acrylate co-polymer such that 2.5% to 10% by weight of the fabric of the fluoroalkyl acrylate co-polymer solution is applied.

44. The process according to claim 43 wherein said aqueous bath includes magnesium chloride formulated to be applied up to 4% of the fabric weight and ethoxylated aliphatic alcohol formulated to be applied up to 1% of the fabric weight.

45. The process according to claim 44 wherein the pH of said bath is within the range of 3.5 to 4.5.

* * * * *

UNITED STATES PATENT AND TRADEMARK OFFICE

CERTIFICATE OF CORRECTION

PATENT NO. : 6,825,138 B2 
DATED : November 30, 2004
INVENTOR(S) : Ronnie Franklin Lack It is certified that error appears in the above-identified patent and that said Letters Patent is hereby corrected as shown below:

Column 1,
Line 11, after the word "treatment", delete "oftextiles" and insert therefor -- of textiles --.

Column 7,
Line 13, after the word "the", delete "hydoxyl" and insert therefor -- hydroxyl --.
Line 28, after the word "bath", delete "containing".

Column 8,
Line 1, after the word "bath", delete "containing".

Signed and Sealed this

Twenty-sixth Day of July, 2005

JON W. DUDAS
*Director of the United States Patent and Trademark Office*